United States Patent [19]

Thomas

[11] Patent Number: 4,687,208

[45] Date of Patent: Aug. 18, 1987

[54] COURT BALL GAME

[76] Inventor: Squire J. Thomas, 2200 Wheatley Dr., Apt. 101, Baltimore, Md. 21207

[21] Appl. No.: 944,819

[22] Filed: Dec. 22, 1986

[51] Int. Cl.[4] ..... A63B 71/02; A63C 19/00

[52] U.S. Cl. ..... 273/411; 273/2; 273/41; 273/82 B; 273/118 R; 273/428

[58] Field of Search ..... 273/411, 2, 3 R, 3 A, 273/37, 41, 82 R, 82 B, 118 R, 128 R, 128 A, 67 R, 428

[56] References Cited

U.S. PATENT DOCUMENTS

| | | | |
|---|---|---|---|
| 196,356 | 10/1877 | Harrington | 273/118 R |
| 196,357 | 10/1877 | Harrington | 273/118 R |
| 1,164,791 | 12/1915 | Desenberg | 273/3 A X |
| 2,629,601 | 2/1953 | Rockola | 273/82 B X |
| 3,231,278 | 1/1966 | Boulanger | 273/118 R |
| 3,504,914 | 4/1970 | Bradbury | 273/118 R |

*Primary Examiner*—William H. Grieb

*Attorney, Agent, or Firm*—John F. McClellan, Sr.

[57] ABSTRACT

A court game has a plurality of spots on which duckpin shaped "S"-balls are initially positioned in a pattern relative to a greater plurality of pins in a pattern. Players in turn try to score points by caroming a soft rubber ball off an "S"-ball and striking with the caromed soft rubber ball a pin, in a way like billiards. To improve probability of doing so, the player may elect to shift the "S"-ball closer to a pin by throwing a special bat at it, even though throwing a bat costs a score penalty. Pins for soft-court use and for paved or hard court use are described.

4 Claims, 7 Drawing Figures

COURT BALL GAME

FIELD OF THE INVENTION

This invention relates generally to games of skill and specifically to a court game played with balls, bats and pins according to formal rules.

BACKGROUND OF THE INVENTION

Bowling games are known, played with upright pins and balls on an alley or court. Pins of different configurations are also known, and also scoreboards are known.

SUMMARY OF THE INVENTION

A principal object of this invention is to provide a game system of the type described that is novel in play and appearance and in challenge to the players, and is fun for all ages able to play it.

Further objects are to provide a system as described that will accommodate a plurality of players, that offers a choice of pin types for use with hard of soft surfaces, that is easy to learn to play, and to play, and that is safe, durable, convenient and is attractive in appearance.

In brief summary the game is played on a court having organized locations for movable objects placed thereon and played with a soft rubber ball or first object for projection by a player against a movable second object distal therefrom to cause caroming of the ball from the second object onto a third object usually distal from the second object to score points. Bats or fourth objects are provided to be thrown at the second objects to drive them closer to the third objects so that the ball may be more easily projected against and from or more easiy bounced off the second object on to the third object.

BRIEF DESCRIPTION OF THE DRAWINGS

Further objects and advantages of this invention will become more readily apparent on examination of the following description, including the drawings in which like reference numerals refer to like parts.

DETAILED DESCRIPTION

Figure 1:
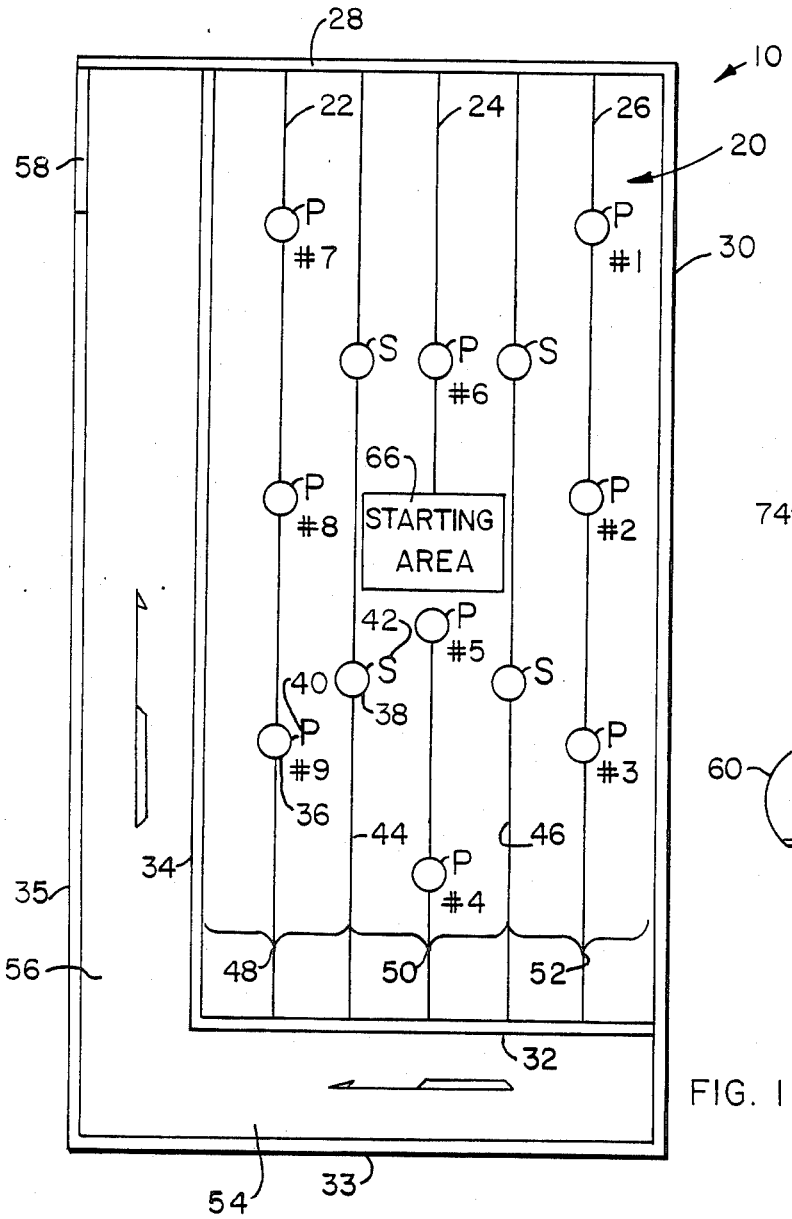
FIG. 1 is a plan view of parts of the apparatus of the preferred embodiment.

The game is to be played by three people or more on a layout as in embodiment 10. Apparatus includes a court of diamond 20 that may be an outdoor flat piece of ground or a hard surface such as a floor indoors, with suitable markings. The markings include three line markers 22, 24, 26, for placing pins thereon, out-of-bounds line markers 28, 30, 32, 34, 35 (preferably walls) and thirteen position markers or "spots" 36, 38 with thirteen designations 40, 42 of playing elements ("P" for pin and "S" for "S"-ball) to be placed on them at the start of play. The court may have recesses for pins. Parallel lines 44, 46 help in guiding and aligning shots or plays by defining playing lanes 48, 50, 52. Walk lanes 54, 56 are on two sides of the court and intersect. Entrance is at 58.

Figure 4:
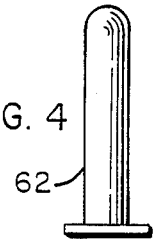
FIG. 4 is an elvational view of an inside-use hard surface pin.
Figure 5:
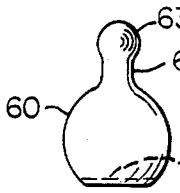
FIG. 5 is an elevational view of an "S-ball"
Figure 6:
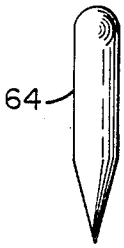
FIG. 6 is an elevational view of an outside use pin.
Figure 7:
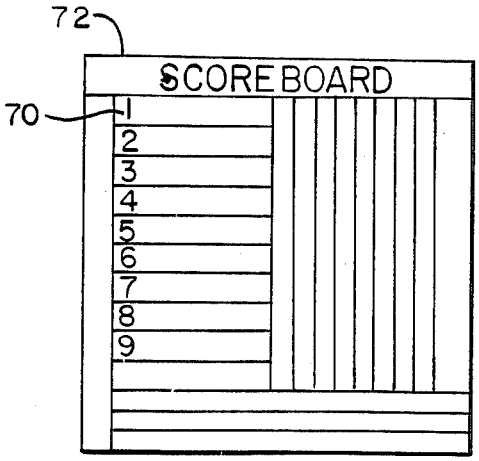
FIG. 7 is a face view of a scoreboard.

The playing elements include four "S"-balls, 60, FIG. 5, to go on locations 42, the "S"-ball spots, and nine pins, either flat bottom as at 62, FIG. 4, for hard surface "indoor" use or pointed as at 64, FIG. 6, for soft surface "outdoor" use stuck in holes (which may be) in the ground at 40. The pins 62 or 64 are placed at spots 40.

Each player stands in the area 66 marked "Starting Area".

Figure 2:
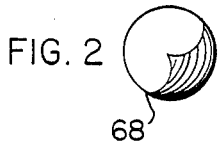
FIG. 2 shows a ball portion thereof.

Object of the games is to score the most points by rolling or throwing the soft rubber ball 68, FIG. 2 (which all players use) against an "S"-ball so that the soft rubber ball 68 richochets as in a billiard shot or caroms off the "S"-ball and strikes a pin 62 or 64 depending on type pin used). Striking a pin in this way scores a full point, which is recorded against one of the player's names, listed by number 70 on the scoreboard 72. The scoreboard preferably is located near the entrance 58.

Figure 3:
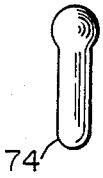
FIG. 3 is an elevational view of a bat.

Should a player want to increase his or her chances of caroming the rubber ball 68 off the "S"-ball and onto a pin (62, for example), the player can grasp a bat 74, FIG. 3, and throw it at the "S"-ball, attempting to shift the "S"-ball closer to the pin planned to be hit by the soft rubber ball 68 bounced off the "S"-ball 60. Each player has three bats 74, and must deduct a quarter point each time he or she uses (throws) a bat, up to a maximum of three quarters of a point lessening of his or her score. If the bat misses, the player must still deduct the quarter point. The bats are left where they fall, as are the pins if knocked down. Any knocked-over "S"-balls will set themselves up because of weight 76 in the bottom and are spotted again only if out of the boudary lines. The pins may be re-spotted.

A player shoots until he or she misses, after the start, always standing on the opposite side of the foul line from the "S"-ball and pin aimed to be hit.

Stepping into the side where the "S"-ball is, or where the pin aimed-at is, comprises a foul. If an "S"-ball gets out of the playing area it can be put back in at the "S"-ball spot nearest the end from which the player is shooting. If a player causes the outage by interference with the play of another to his own gain, the player interfering loses all points. Anytime a player shooting is interfered with, another shot is allowed that player.

Sequence of play is to begin with an "S"-ball onto pin at location marked #1 and then to proceed down the lane to #2, #3 and, in turn, up to the next lane to #4, etc. Play can stop when all or any chosen number of pins are knocked down or off the spots.

The scoreboard 72 can be of paper, eight inches (20 cm) by 5 inches (13 cm) and each player can have one or all can use the same if posted. The court or diamond 20 inside would be 15 by 28 feet (4 by 8.3 m). Each playing lane should be 4 feet by 25 feet (1.2 by 7.5 m). The walk lanes 54, 56 should be 3 feet (0.9 m) wide.

The starting area 66 may be about 2 ft. by 2 ft. (0.6 m by 0.6 m). From the starting area to the center lane pin should measure 4 feet (1.2 m)p to #1 pin, 7 feet (2.1 m) to #3 pin, 4 feet (2.1 m) from the boundary 28, then 7 feet (2.1 m) to pins #2 and #3. From boundary 28 to pin at #6 should be 7 feet (2.1 m) and the same to the other pins, as shown.

The "S"-balls 60 may be of duck-pin size and shape, with the weight 76 in the flat bottom for stability. The spherical lower portion may be 8 inches (20 cm) in diameter and 11 inches (28 cm) in height. The necked down portion 61 may be 2 inches (5 cm) in diameter for better engagement by ball or a bat below the 4 inch (10 cm) diameter upper knob 63 provided for safety. The pin may be 2.5 inches (6 cm) in diameter and 10 to 12 inches (28 cm to 30 cm) high with rounded upper ends for safety.

The bat may be 1¼ inches (3.1 cm) in diameter and about 11 inches (28 cm) long with a knob 4 inches (10 cm) from the end for better grip and better engagement with an "S"-ball when thrown, and for safety. The rubber ball 68 may be 5 inches (12.5 cm) in diameter. Material of the bats and pins may be any suitable wood or even thermoplastic; hollow construction may be used for safety. The "S"-balls may be covered with leather with a rubber inner-tube construction.

The pattern of spots 36, 38 on one end of the court 20 may be as shown, diamond-shaped and in the other end I-beam section shaped, for variety, convenience and access and interest.

It will be appreciated that this novel game offers a chance for the players to develop great skill and derive great excitement from competing in playing this game.

The game offers diverse opportunities for skillful play, for example, the "S"-balls have shapes for selectively deflecting a projected ball laterally, downwardly and upwardly. The pins preferably do not move and are re-set if knocked over.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for playing a game of skill on a defined court by player projection of a first object against a second object distal therefrom to cause caroming of the projected object from the second object onto a third object distal from the second object to score points, characterized by: the first object being a ball, a plurality of said second, third and fourth objects, each second object having a shape for selectively deflecting a ball laterally downwardly and upwardly, each third object being a cylindrical pin having means for holding it upright, and each fourth object comprising means for increasing probability of causing said caroming onto the pin, by being thrown against a second object and shifting the second object closer to the pin, each said means for shifting being in the form of a bat.

2. A system as recited in claim 1, the second object shape being like the shape of a duckpin, and the bat having a knob on an end thereof.

3. A system as recited in claim 1, the defined court being rectangular and having a plurality of recesses located thereon in a pattern for holding pins.

4. A system as recited in claim 2, the defined court having a plurality of lanes with location indicia thereon for location of said second and third objects.

* * * * *